US007747206B2

(12) United States Patent
Yamana et al.

(10) Patent No.: US 7,747,206 B2
(45) Date of Patent: Jun. 29, 2010

(54) FIXING APPARATUS AND IMAGE FORMING APPARATUS

(75) Inventors: Shinji Yamana, Yamatokoriyama (JP); Kenji Asakura, Kyoto (JP); Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 508 days.

(21) Appl. No.: 11/684,101

(22) Filed: Mar. 9, 2007

(65) Prior Publication Data

US 2007/0217837 A1 Sep. 20, 2007

(30) Foreign Application Priority Data

Mar. 14, 2006 (JP) ..... 2006-069982

(51) Int. Cl.
*G03G 15/20* (2006.01)

(52) U.S. Cl. ..... 399/328

(58) Field of Classification Search ..... 399/107, 399/122, 320, 328–330; 219/216, 619
See application file for complete search history.

(56) References Cited

U.S. PATENT DOCUMENTS

| | | | | |
|---|---|---|---|---|
| 6,559,421 | B1 * | 5/2003 | Yura et al. | 219/216 |
| 6,865,365 | B2 * | 3/2005 | Kim et al. | 399/330 |
| 7,194,233 | B2 * | 3/2007 | Wu et al. | 399/328 |
| 2002/0113050 | A1 | 8/2002 | Yura et al. | |
| 2003/0063916 | A1 * | 4/2003 | Katayanagi et al. | |
| 2003/0192869 | A1 | 10/2003 | Yura et al. | |
| 2005/0117942 | A1 | 6/2005 | Ishii | |
| 2005/0226660 | A1 | 10/2005 | Fuma | |
| 2006/0013623 | A1 * | 1/2006 | Kagawa et al. | 399/328 |

FOREIGN PATENT DOCUMENTS

| | | | |
|---|---|---|---|
| JP | 58-016272 A | | 1/1983 |
| JP | 2001-282020 A | | 10/2001 |
| JP | 2003-151722 A | | 5/2003 |
| JP | 2004-198659 | | 7/2004 |
| JP | 2005062554 A | * | 3/2005 |
| JP | 2005-189427 | | 7/2005 |
| JP | 2005-300800 A | | 10/2005 |

OTHER PUBLICATIONS

English Machine Translation of JP 2004-198659 A, Jul. 15, 2004.*

* cited by examiner

*Primary Examiner*—David P Porta
*Assistant Examiner*—Milton Gonzalez
(74) *Attorney, Agent, or Firm*—Renner, Otto, Boisselle & Sklar, LLP

(57) ABSTRACT

A fixing apparatus includes: a fixing roller and a pressure roller which transport a recording paper while sandwiching the recording paper P therebetween so that an unfixed toner image formed on the recording paper is fixed thereon under heat and pressure; two support rollers; an endless belt which is set over the support rollers and comes into contact with a surface of the fixing roller; and heater lamps which are provided respectively inside the support rollers. A fixing apparatus satisfies a relationship indicated by $(C2+C3)/C1 \geqq 2$ where C1 is a heat capacity of each of the heater lamps, C2 is a heat capacity of each of the support rollers, and C3 is a heat capacity of the endless belt in each of areas where the endless belt is in contact with the support rollers. This realizes an external belt heat fixing apparatus which suppresses (a) heat damage to the endless belt and the surface of the fixing member and (b) unevenness of an image.

5 Claims, 7 Drawing Sheets

FIXING APPARATUS AND IMAGE FORMING APPARATUS

This Nonprovisional application claims priority under 35 U.S.C. §119(a) on Patent Application No. 69982/2006 filed in Japan on Mar. 14, 2006, the entire contents of which are hereby incorporated by reference.

FIELD OF THE INVENTION

The present invention relates to (i) a fixing apparatus which is included in an electrophotographic image forming apparatus, and (ii) an electrophotographic image forming apparatus including the fixing apparatus.

BACKGROUND OF THE INVENTION

A fixing apparatus used in an electrophotographic image forming apparatus such as a copying machine, a printer, and the like, is typically constituted by a pair of rollers (fixing roller and pressure roller) which are pressed against each other. As such a fixing apparatus, a heat roller type fixing apparatus is frequently used, wherein halogen heaters disposed in both the rollers or a halogen heater disposed in one of the rollers heat the pair of rollers at a predetermined temperature (fixing temperature), and a recording paper P on which an unfixed toner image is formed is allowed to pass through a pressing section (fixing nip area) of the pair of rollers so as to fix the toner image under heat and pressure.

Especially, in a fixing apparatus provided in a color image forming apparatus, it is general to use an elastic roller having an elastic layer which is made of silicon rubber or the like and which is provided on a fixing roller surface layer.

The elastic roller is used as the fixing roller, so that the fixing roller surface is elastically deformed corresponding to an uneven surface of the unfixed toner image and is in contact with the toner image so as to cover the toner image. This allows the color unfixed toner image whose toner amount is larger than that of monochrome unfixed toner image to be favorably fixed under heat. Further, due to strain release of the elastic layer which occurs in the fixing nip area N1, it is possible to improve a releasing property with respect to color toner which is more likely to offset than monochrome toner. Further, a nip shape of the fixing nip area N1 has a concave upward (that is, the nip shape is a so-called inverse nip shape), so that it is possible to more favorably separate the recording paper P from the fixing roller. As a result, it is possible to separate the recording paper P without using any separation means such as a separation claw (self stripping), so that it is possible to prevent insufficient image formation which is caused by the separation means.

However, in the fixing roller having the elastic layer, the elastic layer cannot sufficiently conduct heat. Thus, in case where the heating means is provided in the fixing roller, heat is less efficiently conducted, so that it takes longer time to warm up. In case where the process is carried out at higher speed, the fixing roller cannot follow the process.

As a method for solving these problems, an arrangement in which external heating means is brought into contact with the fixing roller surface so that the fixing roller is heated from the outside (external heat fixing process) is known. Especially, an arrangement in which an endless belt is used as the external heating device (external belt heat fixing process) has been recently proposed (Patent document 1: Japanese Unexamined Patent Publication No. 198659/2004 (Tokukai 2004-198659; published on Jul. 15, 2004) and Patent document 2: Japanese Unexamined Patent Publication No. 189427/2005 (Tokukai 2005-189427; published on Jul. 14, 2005).

However, the above external belt heat fixing process that was conventionally carried out offers a high ability to supply heat to the fixing roller. In addition, heat is transmitted from the heat source to the fixing roller surface, passing though a plurality of members (an endless belt and support rollers for suspending the endless belt) provided between the heat source and the fixing roller surface. As a result, wide temperature variations occur between the heat source and the fixing roller surface. That is, temperature variations between the heat source, the support rollers, the endless belt, and the fixing roller surface are as follows: heat source>support rollers>endless belt>fixing roller surface.

In a situation where rotation of the fixing roller is stopped, a temperature of each of the support rollers is raised by heat of the heat source even if heat supply from the heat source is stopped. Furthermore, an area of the endless belt where the endless belt is in contact with the support roller is small in heat capacity and thus instantly reaches a temperature that is the same as a temperature of the support rollers. Accordingly, a temperature of the endless belt becomes higher than a temperature that the endless belt has during the fixing operation. This can cause heat damage to the endless belt.

Also, there occurs rise in temperature of the fixing roller surface in an area where the fixing roller is in contact with the support rollers via the endless belt. This causes heat damage to the fixing roller surface or temperature variations in the fixing roller surface. Under such a situation, if the fixing operation is restarted, there occurs unevenness of the image.

That is, as compared with the external heating process in which rollers are brought into contact with a fixing member, a heating nip area becomes wider in the external belt heat fixing process in which the endless belt is brought into contact with the fixing member. Therefore, even if the endless belt has a smaller heat capacity, the endless belt can supply a large amount of heat to the surface of the fixing member, and a temperature of the fixing member can excellently respond to a high-speed fixing. However, when the operation of the fixing member is stopped after the end of the fixing, a temperature of the endless belt in an area where the endless belt is set over the support rollers rapidly increases, the endless belt and the fixing member are partly heated and therefore deteriorated (hereinafter such phenomenon is referred to as overshoot).

SUMMARY OF THE INVENTION

An object of the present invention is to provide (i) an external belt heat fixing apparatus which suppresses (a) heat damage to the endless belt and the surface of the fixing member and (b) unevenness of an image, and (ii) an image forming apparatus including the fixing apparatus.

A fixing apparatus according to the present invention is a fixing apparatus comprising: a fixing member which transports a recording material while sandwiching the recording material so that an unfixed toner image formed on the recording material is fixed on the recording material under heat and pressure; a plurality of support rollers; an endless belt which is set over the support rollers and comes into contact with a surface of the fixing member; and heating means which are provided respectively inside the support rollers, wherein a relationship indicated by the following equation (1) is satisfied: $(C2+C3)/C1 \geqq 2$ . . . (1) where C1 is a heat capacity of the heating means, C2 is a heat capacity of each of the support rollers, and C3 is a heat capacity of the endless belt in each of areas where the endless belt is in contact with the support rollers.

According to the above arrangement, a relationship between the heat capacity C1 of the heating means, the heat capacity C2 of the support rollers, and the heat capacity C3 of the endless belt in each of areas where the endless belt is in contact with the support rollers is as indicated by the above-mentioned equation (1). That is, heat capacities of the support rollers and the endless belt are larger than a heat capacity of the heating means, as compared with the conventional arrangement.

In a situation where the equation (1) is satisfied, rise in temperature of the support rollers is suppressed even when heat of the heating means is transferred to the support rollers after the completion of the fixing (when the rotation of the fixing member is stopped) and at the time of paper jam. As a result, it is possible to suppress local rise in temperature of the endless belt and the fixing member. Thus, it is possible to suppress degradation due to temperatures of the surfaces of the endless belt and the fixing member, and to reduce unevenness of the image.

Further, a fixing apparatus according to the present invention is a fixing apparatus comprising: a fixing member which transports a recording material while sandwiching the recording material so that an unfixed toner image formed on the recording material is fixed on the recording material under heat and pressure; a plurality of support rollers; an endless belt which is set over the support rollers and comes into contact with a surface of the fixing member; and heating means which are provided respectively inside the support rollers, wherein a relationship indicated by the following equation (2) is satisfied: $t/\lambda \leqq 0.001\ m^2K/W$ . . . (2) where t is a thickness of the endless belt, and $\lambda$ is a thermal conductivity of the endless belt.

In a situation where the equation (2) is satisfied, it is possible to suppress the difference in temperature between the belt suspending rollers and the endless belt to not more than approximately 20° C. Further, in a situation where the equation (2) is satisfied, rise in temperature of the endless belt is suppressed even when heat of the heating means is transferred to the support rollers after the completion of the fixing (when the rotation of the fixing member is stopped) and at the time of paper jam. As a result, it is possible to suppress local rise in temperature of the fixing member. Thus, it is possible to suppress degradation due to temperatures of the surfaces of the endless belt and the fixing member, and to reduce unevenness of the image. Still further, in a situation where the equation (2) is satisfied, it was confirmed that degradation due to temperatures of the surfaces of the endless belt and the fixing member was not found and it was possible to reduce unevenness of the image.

It is preferable to reduce the thickness of the endless belt since the reduction in thickness of endless belt decreases the difference in temperature between the support rollers and the endless belt. However, there is the possibility that the reduction in thickness of endless belt leads to decrease of the sum of (a) heat capacity of each of the support rollers and (b) heat capacity of the endless belt. For this reason, it is preferable to reduce the thickness of the endless belt and increase the thickness of the support rollers accordingly in order not to decrease the sum of (a) heat capacity of each of the support rollers and (b) heat capacity of the endless belt.

Further, a fixing apparatus according to the present invention is a fixing apparatus comprising: a fixing member which transports a recording material while sandwiching the recording material so that an unfixed toner image formed on the recording material is fixed on the recording material under heat and pressure; a plurality of support rollers; an endless belt which is set over the support rollers and comes into contact with a surface of the fixing member; and heating means which are provided respectively inside the support rollers, wherein a ratio of a length of the endless belt in a moving direction of the endless belt in an area of the endless belt that is in contact with the surface of the fixing member is not less than 0.1 relative to a peripheral length of the fixing member.

It is clear from the experiment that it is possible to suppress the difference in temperature between the surface of the endless belt and the surface of the fixing member to not more than 30 to 40° C. when a ratio of the heating nip width is not less than 0.1 relative to a peripheral length of the fixing member. Decrease of the difference in temperature between the surface of the endless belt and the surface of the fixing member makes it possible to suppress temperatures of the endless belt and the support rollers to lower temperatures during the fixing operation. As a result, it was confirmed that the above arrangement makes it possible to suppress degradation due to temperatures of the surfaces of the endless belt and the fixing member and to reduce unevenness of the image, after the rotation of the fixing member and the heating of the heating means are stopped due to the completion of the fixing, paper jam, or other reason.

Further, a fixing apparatus according to the present invention is a fixing apparatus comprising: a fixing roller and a pressure roller which transport a recording material while sandwiching the recording material therebetween; a plurality of support rollers; an endless belt which is set over the support rollers and comes into contact with a surface of the fixing roller; and heating means which are provided respectively inside the support rollers, the fixing roller fixing an unfixed toner image formed on the recording material thereon under heat and pressure, the fixing apparatus further comprising: a heat roller which is in contact with a surface of the pressure roller and heats the pressure roller from outside the pressure roller.

According to the above arrangement, by providing the heating roller for the pressure roller that faces the fixing roller, it is possible to reduce the warm-up time and to quickly and efficiently respond to decrease in temperature of the pressure roller during the fixing process. Note that since a temperature of the pressure roller may be lower than that of the fixing roller, the heating roller having a heat source therein can be used. This makes it possible to realize the fixing apparatus that is smaller in size than the fixing apparatus including the external heating device using the endless belt.

Further, quickly heating the pressure roller increases the amount of available heat supplied from the pressure roller to the recording material. As a result, the amount of heat to be supplied from the fixing roller is suppressed. This effect reduces temperature variations between the heating means, the support rollers, and the endless belt all of which are members for supplying heat to the surface of the fixing roller, thus suppressing rise in temperature of the endless belt that is in contact with the fixing roller. This makes it possible to suppress degradation due to temperatures of the surfaces of the endless belt and the fixing member, and to reduce unevenness of the image.

Additional objects, features, and strengths of the present invention will be made clear by the description below. Further, the advantages of the present invention will be evident from the following explanation in reference to the drawings.

DESCRIPTION OF THE EMBODIMENTS

Figure 2:
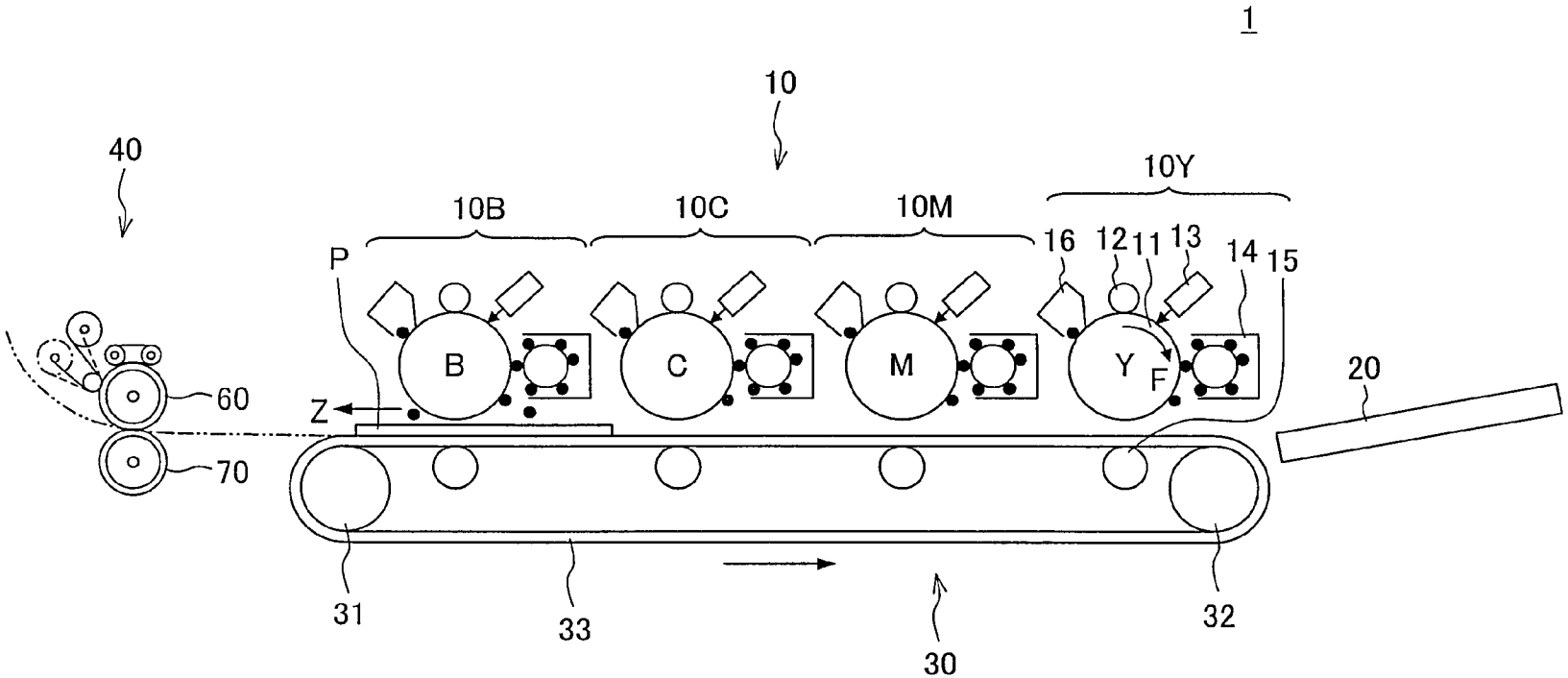
FIG. 2 is a view schematically illustrating an internal structure of an image forming apparatus which includes a fixing apparatus illustrated in FIG. 1.

An embodiment of the present invention will be described below with reference to drawings. First of all, an image forming apparatus which includes a fixing apparatus of the present embodiment will be described with reference to FIG. 2. FIG. 2 is a diagram schematically illustrating an internal structure of the image forming apparatus.

(Structure of the Image Forming Apparatus)

An image forming apparatus 1 illustrated in FIG. 2 is a printer which forms a color image or a monochrome image on a recording paper (recording material) P based on (i) image data that are transmitted from terminal devices each connected to the image forming apparatus 1 via a network or (ii) image data that are scanned by a scanner.

The image forming apparatus 1 is a dry electrophotographic and four drum tandem engine color printer, and includes a visible image transferring section 10, a supply tray 20, a recording paper transporting section 30, and a fixing apparatus 40.

The visible image transferring section 10 consists of a yellow image transferring section 10Y, a magenta image transferring section 10M, a cyan image transferring section 10C, and a black image transferring section 10B. More specifically, the yellow image transferring section 10Y, the magenta image transferring section 10M, the cyan image transferring section 10C, and the black image transferring section 10B are disposed in this order in a direction from the supply tray 20 side toward the fixing apparatus 40 side.

The transferring sections 10Y, 10M, 10C, 10B have substantially the same structure and transfer a yellow image, a magenta image, a cyan image, and a black image on the recording paper P, respectively.

Each of the transferring sections 10Y, 10M, 10C, 10B includes a photoreceptor drum 11. Around the photoreceptor drum 11 are there further disposed an electrostatic charging roller 12, an LSU 13, a development unit 14, a transfer roller 15, and a cleaning device 16, which are arranged along a rotational direction of the photoreceptor drum 11 (direction indicated by an arrow F in FIG. 2).

In each of the transferring sections 10Y, 10M, 10C, 10B, the photoreceptor drum 11 is a drum-shaped roller which has a photosensitive material on a surface thereof, and rotates in a direction indicated by the arrow F. The electrostatic charging roller 12 evenly (uniformly) charges the surface of the photoreceptor drum 11.

To the respective LSUs (laser beam scanner units) 13 of the transferring sections 10Y, 10M, 10C, 10B, pixel signals corresponding to yellow component, magenta component, cyan component, and black component of the image data are supplied, respectively. The LSUs 13 perform exposures of the charged photoreceptor drums 11 in accordance with such image signals to form electrostatic latent images.

The respective development units 14 of the transferring sections 10Y, 10M, 10C, 10B have a yellow toner, a magenta toner, a cyan toner, and a black toner, respectively. The development units 14 have a function of developing, with these toners, the electrostatic latent images formed on the photoreceptor drums 11 to form toner images (developed images).

The respective transfer rollers 15 of the transferring sections 10Y, 10M, 10C, 10B are subjected to application of a bias voltage which is opposite in polarity to toner. By applying the bias voltage to the recording paper P, each of the transfer rollers 15 transfers the toner image formed on the photoreceptor drum 11 onto the recording paper P. The respective cleaning devices 16 of the transferring sections 10Y, 10M, 10C, and 10B remove residual toners from the photoreceptor drums 11 after image transfer onto the recording paper P. Transfer of the toner image onto the recording paper P is carried out once for each color.

The recording paper transporting section 30 is composed of a drive roller 31, an idling roller 32, and a transport belt 33. The recording paper transporting section 30 transports the recording paper P so that toner images are formed on the recording paper P by the transferring sections 10Y, 10M, 10C, 10B in this order.

The drive roller 31 and the idling roller 32 support the transport belt 33 in a tensioned state. The drive roller 31 rotates at a predetermined circumferential speed under control, so that the transport belt 33 rotates.

The transport belt 33 is set over the drive roller 31 and the idling roller 32 so as to come into contact with the photoreceptor drum 11 of the transferring sections 10Y, 10M, 10C, 10B. The transport belt 33 is caused by the rollers 31 and 32 to perform friction drive in a direction indicated by an arrow Z. The transport belt 33 attaches the recording paper P transported from the supply tray 20 by means of electrostatic charges so that the recording paper P is transported to the transferring sections 10Y, 10M, 10C, 10B in this order.

The recording paper P that has the toner images transferred thereon by the transferring sections 10Y, 10M, 10C, 10B is separated from the transport belt 33 by a curvature of the drive roller 31 and then transported to the fixing apparatus 40 (A dashed line in FIG. 2 indicates a path over which the paper sheet P travels.). The toner images that have been transferred onto the recording paper P by the transferring sections 10Y, 10M, 10C, 10B are unfixed with respect to the recording paper P.

Note that, the unfixed toner image is constituted of developer (toner) such as nonmagnetic monocomponent developer (nonmagnetic toner), nonmagnetic bicomponent developer (nonmagnetic toner and carrier), and magnetic developer (magnetic toner).

The fixing apparatus 40 fixes the unfixed toner images, which have been transferred onto the recording paper P, to the recording paper P by thermo compression bonding. More specifically, the fixing apparatus 40 includes a fixing roller (fixing member) 60 and a pressure roller 70 (fixing roller). The recording paper P that has been transported from the visible image transferring section 10 is fed to a fixing nip area that is provided between the fixing roller 60 and the pressure roller 70. Further, the recording paper P is transported between the fixing roller 60 and the pressure roller 70. During the transport, the toner images (unfixed images) formed on the recording paper P are fixed to the recording paper P under heat of the fixing roller 60.

After having been subjected to toner image fixing process by the fixing apparatus 40, the recording paper P is ejected into an external output tray (not shown) that is provided to the image forming apparatus 1. This completes the image forming process.

(Structure of the Fixing Apparatus)

Figure 1:
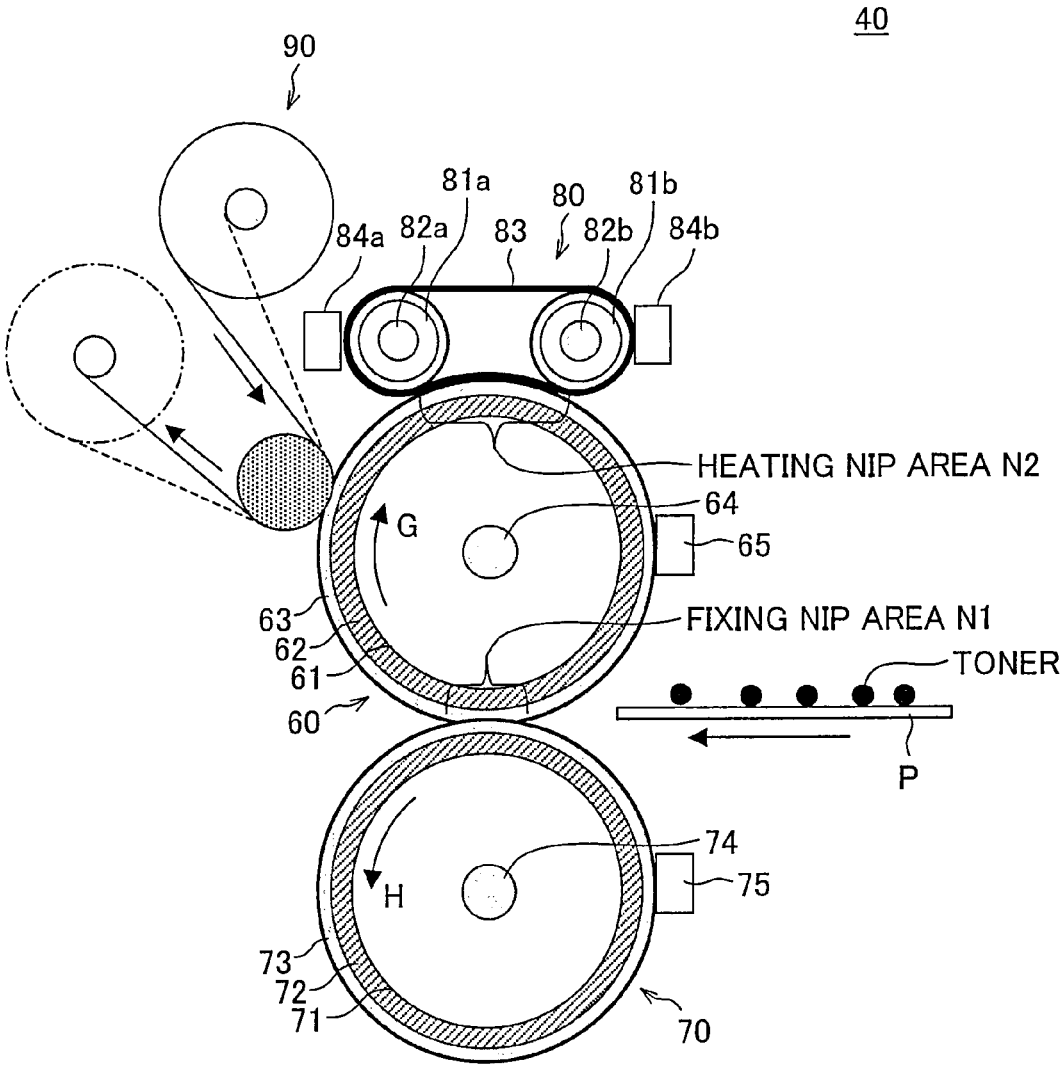
FIG. 1 is a view schematically illustrating a structure of a fixing apparatus according to an embodiment of the present invention.

Next, the above-mentioned fixing apparatus 40 will be specifically described with reference to FIG. 1. FIG. 1 is a diagram schematically illustrating a structure of the fixing apparatus 40 of the present embodiment. The fixing apparatus 40 includes, in addition to the above-mentioned fixing roller 60 and pressure roller 70, a web cleaning device 90 and an external heating device 80.

The fixing roller 60 is a roller that rotates in a direction indicated by an arrow G illustrated in FIG. 1. The fixing roller 60 has a three-layer structure that consists of: a hollow cylindrical shaft 61 that is made of a metal; an elastic layer 62 that coats the perimeter of the shaft 61; and a releasing layer 63 that is formed to coat the elastic layer 62.

The shaft 61 has an external diameter of 46 mm and is made of aluminum. However, a material for the shaft 61 is not limited to aluminum and may be metal such as iron, stainless steel, or copper, or an alloy of any of these metals. The elastic layer 62 has a thickness of 3 mm and is made of silicone rubber having heat resistance. The releasing layer 63 is realized by a PFA (tetrafluoroethylene-perfluoroalkyl vinyl ether copolymer) tube having a thickness of approximately 30 μm. A material for the releasing layer 63 may be anything, provided that it is excellent in heat resistance, durability, and toner releasing property. The material for the releasing layer 63 may be fluorine material such as PTFE (polytetrafluoroethylene), apart from PFA. The fixing roller 60 made up as above has a surface hardness of 68 degrees (Asker-C hardness).

On the outer surface of the fixing roller 60, a thermistor 65 is in contact with the fixing roller 60. The thermistor 65 detects a temperature of the outer surface of the fixing roller 60. Inside the shaft 61 installed is a heater lamp 64 which performs infrared radiation (heat radiation) in response to power supply from a control circuit (not shown) to the heater lamp 64. The heater lamp 64 is a heat source of the fixing roller 60. When power is supplied to the heater lamp 64, the heater lamp 64 radiates infrared rays. Then, the inner surface of the fixing roller 60 absorbs the infrared rays radiated by the heater lamp 64. Thus, the entire fixing roller 60 is heated. In the present embodiment, the heater lamp 64 is a 1000-watts halogen lamp.

The pressure roller 70 is a roller that rotates in a direction indicated by an arrow H illustrated in FIG. 1. The pressure roller 70 is made up of a hollow cylindrical shaft 71 that is made of metal, an elastic layer 72 that coats the outer surface of the shaft 71, and a releasing layer 73 that is formed to coat the elastic layer 72.

The shaft 71 has an external diameter of 46 mm and is made of aluminum. However, a material for the shaft 71 is not limited to aluminum and may be metal such as iron, stainless steel, or copper, or an alloy of any of these metals. The elastic layer 72 has a thickness of 2 mm and is made of silicone rubber having heat resistance. The releasing layer 73 is realized by a PFA tube having a thickness of approximately 30 μm. A material for the releasing layer 73 may be anything, provided that it is excellent in heat resistance, durability, and toner releasing property. The material for the releasing layer 73 may be fluorine material such as PTFE, apart from PFA. The pressure roller 70 made up as above has a surface hardness of 75 degrees (Asker-C hardness).

On the outer surface of the pressure roller 70, a thermistor 75 is in contact with the pressure roller 70. The thermistor 75 detects a temperature of the outer surface of the pressure roller 70. Inside the shaft 71 installed is a heater lamp 74 which performs infrared radiation (heat radiation) in response to power supply from a control circuit (not shown) to the heater lamp 74. The heater lamp 74 is a heat source of the pressure roller 70. When power is supplied to the heater lamp 74, the heater lamp 74 radiates infrared rays. Then, the inner surface of the pressure roller 70 absorbs the infrared rays radiated by the heater lamp 74. Thus, the entire pressure roller 70 is heated. In the present embodiment, the heater lamp 74 is a 800-watts halogen lamp.

The fixing roller 60 and the pressure roller 70, each of which has an external diameter of 50 mm, are pressed against each other under a predetermined load (here, 600 N) by an elastic member (spring) although it is not shown. This forms a fixing nip area N1 between the outer surface of the fixing roller 60 and the outer surface of the pressure roller 70. The fixing nip area N1 is the area where the fixing roller 60 and the pressure roller 70 abut on each other. In the present embodiment, the fixing nip area N1 was 9 mm in width along the rotational directions of the fixing roller 60 and the pressure roller 70. The recording paper P passes through the fixing nip area N1 where the fixing roller 60 is heated to a predetermined temperature (180° C. in the present embodiment), so that a toner image is fixed on the recording paper P. At the time when the recording paper P passes though the fixing nip area N1, the fixing roller 60 abuts on a toner image formation surface of the recording paper P, while the pressure roller 70 abuts on a surface of the recording paper P which surface is opposite to the toner image formation surface.

It is to be noted that a driving motor (driving means), which is not shown, is provided by which the fixing roller 60 is rotationally driven, so that the recording paper P passes through the fixing nip area N1. The pressure roller 70 is rotated (in a direction indicated by an arrow H) by the fixing roller 60 rotating (in a direction indicated by the arrow G). In other words, the fixing roller 60 and the pressure roller 70 are opposite in their rotational direction.

Further, in accordance with a rotational speed of the fixing roller 60 driven by the driving motor, the recording paper P on which the unfixed toner image has been formed is transported to the fixing nip area N1 at a predetermined fixing speed and a predetermined copying speed, and the unfixed toner image is fixed by heat and pressure. Note that, the fixing speed is a so-called process speed. The fixing speed is 355 mm/sec, for example. Further, the copying speed means the number of sheets copied per one minute. The copying speed is 70 sheets/minute, for example.

The web cleaning device 90 is the device for cleaning the fixing roller 60.

The external heating device 80 consists of a first support roller 81*a*, a second support roller 81*b*, and an endless belt 83.

The endless belt 83 is a belt whose outer surface abuts on the surface of the fixing roller 60 so as to heat the surface of the fixing roller 60 while the endless belt 83 is heated to a predetermined temperature (for example, 210° C. in the present embodiment). The endless belt 83 is set over the support rollers 81*a* and 81*b* so that an inner surface of the endless belt 83 abuts on outer surfaces of the support rollers 81*a* and 81*b*.

The endless belt 83 is provided on an upstream side with respect to the fixing nip area N1 of the fixing roller 60. As described later, the endless belt 83 is pressed against the outer surface of the fixing roller 60 at a predetermined pressure (40N in the present embodiment). This forms a nip area N2 (hereinafter referred to as heating nip area) between the outer surface of the endless belt 83 and the outer surface of the fixing roller 60, and the outer surface of the endless belt 83 comes into contact with the outer surface of the fixing roller 60. Note that a nip width of the heating nip area N2 is 20 mm (a width of the heating nip area N2 in circumferential direction of the fixing roller 60). At the rotation of the fixing roller 60, the fixing roller 60 causes the endless belt 83 to make cyclic movement, whereby the support rollers 81*a* and 81*b* are rotated.

The endless belt 83 has a two-layer structure in which a 90 μm-thick hollow cylindrical base material which is made of polyimide and includes carbon black dispersed therein is coated with a releasing layer made of fluorocarbon resin that is a mixture of PTEF and PFA and has a thickness of 10 μm. The base material, which is one of the members constituting the two-layer structure, may be heat resisting resin or metal such as stainless steel, nickel, or iron, apart from polyimide. The releasing layer is a synthetic resin material which has an excellent heat resistance and excellent toner releasing property (for example, fluorocarbon resin such as PFA and PTFE). In order to reduce a deviation force of the endless belt 83, an inner surface of the base material of the endless belt 83 may be coated with fluorocarbon resin or the like.

The first support roller 81*a* and the second support roller 81*b* are rollers each of which is realized by a hollow cylindrical shaft made of aluminum and having an external diameter of 15 mm and a thickness of 1 mm. Note that a material for the shaft is not limited to aluminum and may be an iron material. If necessary (for example, in order to reduce a deviation force of the endless belt 83 caused by travel of the endless belt 83 in a snaking manner by reducing frictional forces produced between the inner surface of the endless belt 83 and the first support roller 81*a* and between the inner surface of the endless belt 83 and the second support roller 81*b*), the first support roller 81*a* and the second support roller 81*b* each may be made up of the shaft and a releasing layer formed on the shaft. A material for the releasing layer may be anything, provided that it is excellent in heat resistance, durability, and toner releasing property. The material for the releasing layer can be fluorine material such as PFA or PTFE (polytetrafluoroethylene).

Note that in the external heating device 80, the outer surface of the endless belt 83 is in contact with thermistors 84*a* and 84*b* that detect a temperature of the outer surface of the endless belt 83.

Inside the first support roller 81*a* provided is a heater lamp (heating means) 82*a* that heats in response to power supply to the heater lamp 82*a*. The heater lamp 82*a* is a heat source of the endless belt 83. When power is supplied to the heater lamp 82*a*, the heater lamp 82*a* emits light and radiates infrared rays. Similarly, inside the second support roller 81*b* provided is a heater lamp (heating means) 82*b* that heats in response to power supply to the heater lamp 82*b*. The heater lamp 82*b* is a heat source of the endless belt 83. When power is supplied to the heater lamp 82*b*, the heater lamp 82*b* emits light and radiates infrared rays. This heats inner surfaces of the support rollers 81*a* and 81*b*, which indirectly heats the endless belt 83 via the support rollers 81*a* and 81*b*.

In the present embodiment, the endless belt 83 is set over the two support rollers 81*a* and 81*b*. However, the endless belt 83 may be set over three or more rollers which include a tension roller additionally provided, if necessary (This is because there is a limit to the extent to which only two support rollers 81*a* and 81*b* can support the endless belt so that a wide heating nip width between the fixing roller 60 and the endless belt 83 is secured, for example.).

A control circuit (not shown) as temperature controlling means controls power supplies to the heater lamps 64, 74, 82*a*, 82*b* in accordance with temperature data detected by the thermistors 65, 75, 84*a*, 84*b*, respectively, so that temperatures of the fixing roller 60, the pressure roller 70, and the external heating device 80 become a predetermined temperature.

(Structure of External Heating Device)

Figure 3:
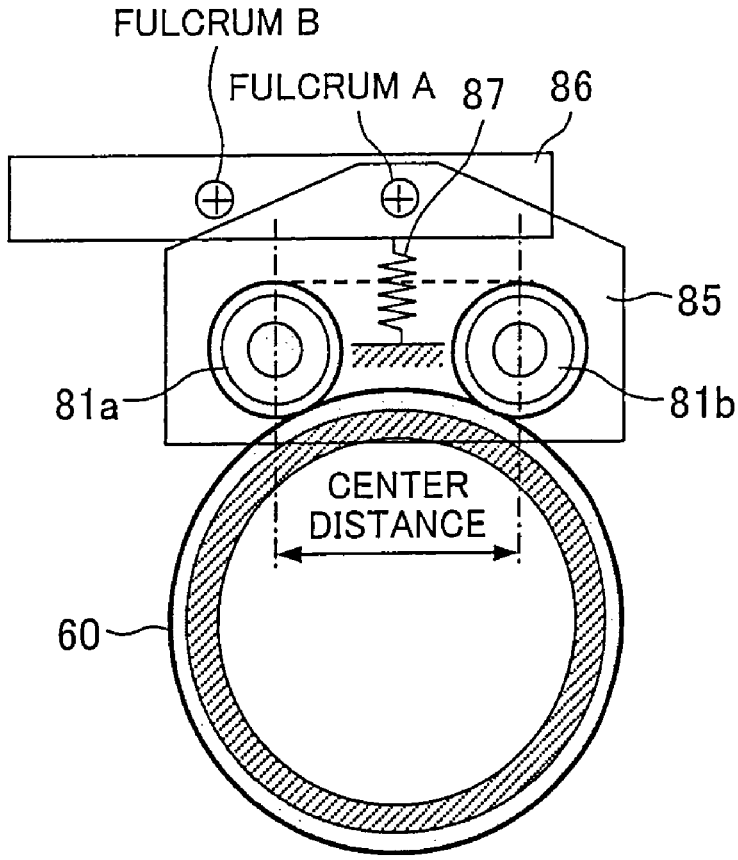
FIG. 3 is a sectional view illustrating a structure of an external heating device which is provided in the fixing apparatus illustrated in FIG. 1.
Figure 4:
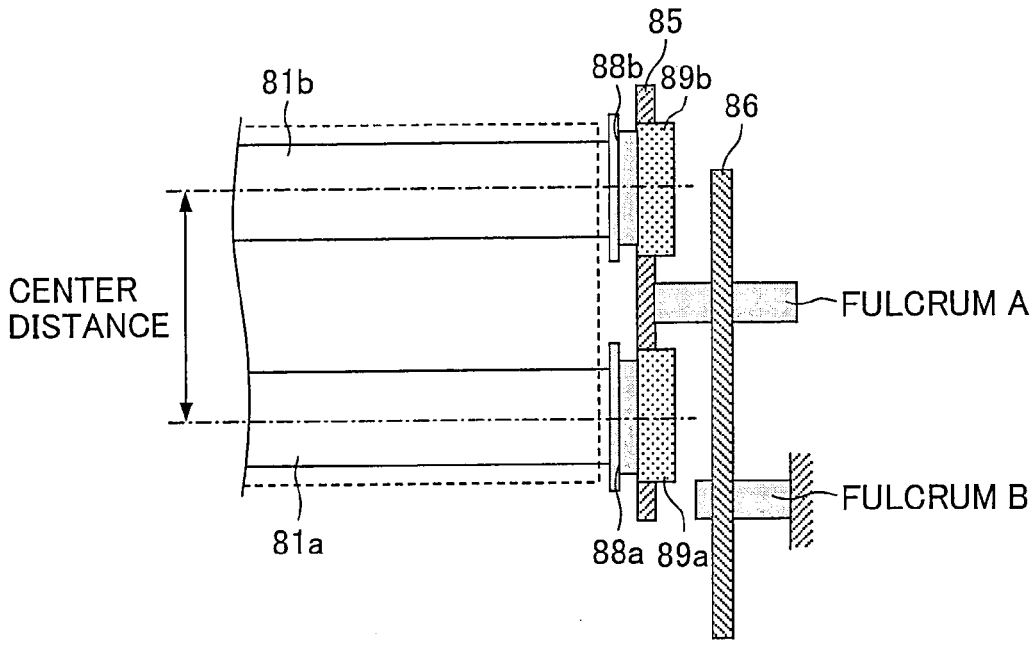
FIG. 4 is a top view of the external heating device which is provided in the fixing apparatus illustrated in FIG. 1.

Next, with reference to FIGS. 3 and 4, a structure of the external heating device 80 according to the present embodiment will be detailed. FIG. 3 is a cross sectional view illustrating the structure of the external heating device 80, and FIG. 4 is a top view thereof.

The support rollers 81*a* and 81*b* are attached to a main body of the image forming apparatus 1 via a side frame 85 and the arm 86.

The arm 86 is axially supported by the main body of the image forming apparatus 1 so as to be rotatable around a fulcrum B.

The side frame 85 is axially supported by the arm 86 so as to be rotatable around a fulcrum A, and includes bearings 89*a* and 89*b* for supporting the support rollers 81*a* and 81*b* so that the support rollers 81*a* and 81*b* are rotatable.

The support rollers 81*a* and 81*b* suspending the endless belt 83 are supported by the bearings 89*a* and 89*b* that are attached to the side frame 85, respectively, so as to be rotatable.

Note that the bearings 89*a* and 89*b* are fixed to the side frame 85 at a predetermined center distance (23.0 mm in the present embodiment) therebetween. At this time, a peripheral length (internal diameter) of the endless belt 83 is 94.24 mm at room temperature. Since the bearings 89*a* and 89*b* are fixed to the side frame 85, a parallelism between the support rollers 81*a* and 81*b* is secured. Thus, in the present embodiment, a parallelism tolerance of the support rollers 81*a* and 81*b* is not more than 100 μm.

Further, a coil spring 87 is attached to the arm 86 at the fulcrum A or near the fulcrum A. The coil spring 87 gives a predetermined load to the arm 86. This causes the side frame 85 attached to the arm 86 to be pushed toward the fixing roller 60. As a result, the support rollers 81*a* and 81*b* axially supported by the side frame 85 are pressed against the fixing roller 60 with equal loads (40N in the present embodiment), as illustrated in FIG. 3.

Further, deviation preventing members 88*a* and 88*b* for preventing the external belt 83 from snaking are provided respectively on the sides of the bearings 89*a* and 89*b* where the support rollers 81*a* and 81*b* are disposed. The deviation preventing members 88*a* and 88*b* are provided for the purpose of restricting deviation of the snaking endless belt 83 by rotating in combination with a side portion of the endless belt 83 and the purpose of preventing the side portion of the endless belt 83 from being abraded or torn due to sliding of the end portion of the endless belt 83.

Figure 5:
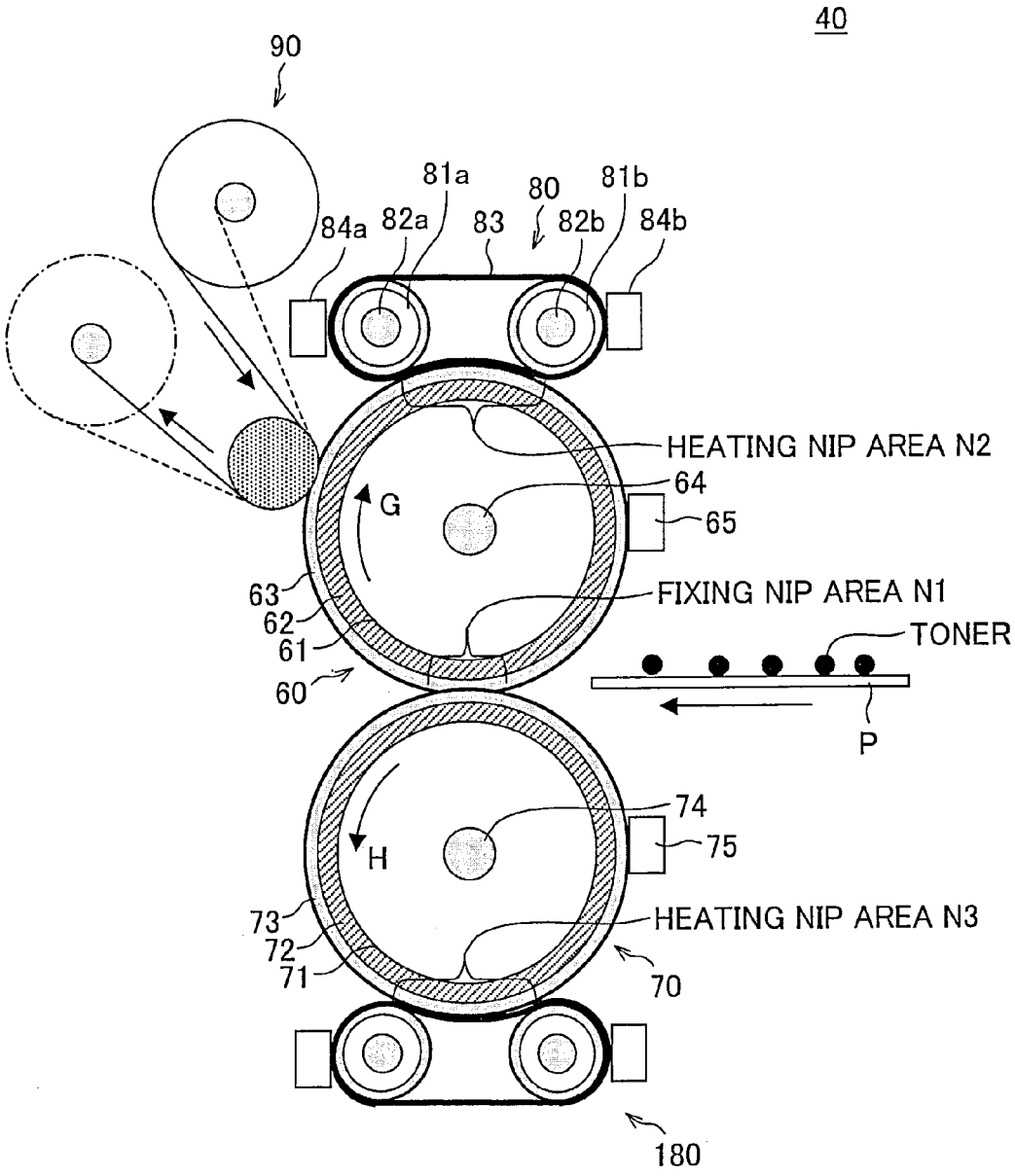
FIG. 5 is a diagram schematically illustrating a structure of a modified fixing apparatus according to an embodiment of the present invention.

Note that in FIG. 1, the external heating device 80 is provided to only the fixing roller 60. However, as illustrated in FIG. 5, external heating devices may be provided to both the fixing roller 60 and the pressure roller 70. That is, an external heating device 180 may be provided that forms a heating nip area N3 between the outer surface of the pressure roller 70 and the external heating device 180. The external heating device 180 has a structure that is the same as that of the external heating device 80.

As described above, the fixing device 40 of the present embodiment is such that heat generated by the heater lamps 82*a* and 82*b* in the external heating device 80 is transmitted to the fixing roller 60 via the support rollers 81*a* and 81*b* and the endless belt 83. Meanwhile, the support rollers 81*a* and 81*b* are rotated by cyclic movement of the endless belt 83. Thus, when the fixing roller 60 stops rotating, the endless belt 83 and the support rollers 81*a* and 81*b* stop rotating. At this time, even when power supplies to the heater lamps 82*a* and 82*b* in the support rollers 81*a* and 81*b* are stopped, the heat of the heater lamps 82*a* and 82*b* raises temperatures of the endless belt 83 and the heating nip area N2 of the fixing roller 60. However, in the present embodiment, it is possible to prevent the endless belt 83 and the heating nip area N2 of the fixing roller 60 from being subjected to temperature degradation, which occurred in the past at the time of stopping rotation of the fixing roller 60, since the arrangement described below is included in the present embodiment.

EXAMPLE

In the present Example, the heater lamp 82*a* and 82*b* that were provided inside the support rollers 81*a* and 81*b*, respectively, were 500 W-halogen lamps. Glass tubes of the heater lamps 82*a* and 82*b* each had an external diameter of 6 mm and a thickness of 1 mm. A gas filled in each of the glass tubes was a mixture gas having a thermal conductivity of $110\times10^{-4}$ W/mK and being made up of 45% argon, 54% xenon, and 1% bromide.

Each of the heater lamps 82*a* and 82*b* was 320 mm long. A heat capacity C1 of each of the heater lamps 82*a* and 82*b* was 10.5 J/K (joule/kelvin). Most of the heat capacity C1 is a heat capacity of the glass tube.

Next, the support rollers 81*a* and 81*b* were hollow pipes made of aluminum and having an external diameter of 15 mm and a length of 320 mm. The support rollers 81*a* and 81*b* each had a thickness of 1 mm. A heat capacity C2 of each of the support rollers 81*a* and 81*b* was 35. 8 J/K.

Further, the endless belt 83 was a belt that includes carbon black dispersed therein and made of polyimide. The endless belt 83 had a peripheral length of 94. 24 mm, a thickness of 0.1 mm, a length of 320 mm in a major axis direction of the support rollers 81*a* and 81*b*, a heat capacity of 5.3 J/K, a thermal conductivity of 0.5 W/(m·K), a glass transition temperature Tg of 310° C., and a continuous operation temperature (highest temperature at which the endless belt 83 are able to continuously operate for a predetermined time period) of 240° C. Note that the heat capacity C3 of the endless belt 83 in each of the areas where the endless belt 83 is in contact with the support rollers 81*a* and 81*b* was 1.3 J/K. A width of the heating nip area N2 that is a peripheral length of the endless belt 83 in contact with the surface of the fixing roller 60 was 20 mm.

In the present Example, in order to obtain a fixing temperature 180° C., temperature variations of the members during fixing operation were as follows: a temperature of each of the support rollers 81*a* and 81*b* was 230° C., a temperature of the endless belt 83 was 210° C., a temperature of the surface of the fixing roller 60 before passing through the fixing nip was 180° C.

Here, when power supplies to the heater lamps 64, 74, 82*a*, 82*b* were stopped upon the fixing roller 60 stopping rotating due to paper jam, temperatures of the glass tubes of the heater lamps 82*a* and 82*b* were approximately 330° C. The heat of the glass tubes was transmitted by radiation to the support rollers 81*a* and 81*b*. This raised temperatures of the support rollers 81*a* and 81*b*. Temperatures of the support rollers 81*a* and 81*b* increased to a maximum of approximately 250° C. ten seconds or so after the stops of the rotation and the power supplies, and a temperature of the endless belt 83 in each of the areas where the endless belt 83 was in contact with the support rollers 81*a* and 81*b* increased up to approximately 250° C. A surface temperature of the fixing roller 60 in areas where the fixing roller 60 was in contact with the support rollers 81*a* and 81*b* via the endless belt 83 increased up to approximately 190 to 200° C.

At this time, the endless belt 83 made of polyimide was not subjected to heat damage. In the image obtained right after the fixing, almost no unevenness of the image was found by visual observation.

(Heat Capacity Ratio)

In Example described above, the heat capacity C3 of each of the areas where the endless belt 83 was in contact with the support rollers 81*a* and 81*b* was 1.3 J/K.

In this case, a heat capacity ratio of (a) a sum of the heat capacity C2 of each of the support rollers 81*a* and 81*b* and the heat capacity C3 of each of the areas where the endless belt 83 abutted on the support rollers 81*a* and 81*b* to (b) the heat capacity C1 of each of the heater lamps 82*a* and 82*b* was as follows:

$$(C2+C3)/C1=(35.8+1.3)/10.5=3.5$$

The following will describe an experimental result of Comparative Example 1. In Comparative Example 1, conditions are the same as those in Example described above, except that a thickness of each of the support rollers 81*a* and 81*b* was changed from 1 mm to 0.5 mm. The heat capacity C2 of each of the support rollers 81*a* and 81*b* in Comparative Example 1 was 18.5 J/K. A heat capacity ratio of (a) a sum of the heat capacity C2 of each of the support rollers 81*a* and 81*b* and the heat capacity C3 of each of the areas where the endless belt 83 abutted on the support rollers 81*a* and 81*b* to (b) the heat capacity C1 of each of the heater lamps 82*a* and 82*b* was as follows:

$$(C2+C3)/C1=1.9$$

In Comparative Example 1, it was found that temperatures of the support rollers 81*a* and 81*b* increased to a maximum of approximately 280° C. ten seconds or so after the stops of the rotation and the power supplies, and a temperature of the endless belt 83 in each of the areas where the endless belt 83 was in contact with the support rollers 81*a* and 81*b* increased up to approximately 280° C. Also, it was found that a surface temperature of the fixing roller 60 in areas where the fixing roller 60 was in contact with the support rollers 81*a* and 81*b* via the endless belt 83 exceeded 200° C.

The endless belt 83 of polyimide that had undergone the above state caused a rotational failure in which the endless belt 83 stopped without being moved by the fixing roller 60 at the time of the fixing operation. Further, it was observed that the endless belt 83 was floated in the areas where the endless belt 83 was in contact with the fixing roller 60. Due to this float, heat of the endless belt 83 was transmitted inefficiently, which resulted in failure of maintaining the fixing temperature during the fixing operation. In the image obtained right after the fixing operation, unevenness of the image was found by visual observation.

Figure 6:
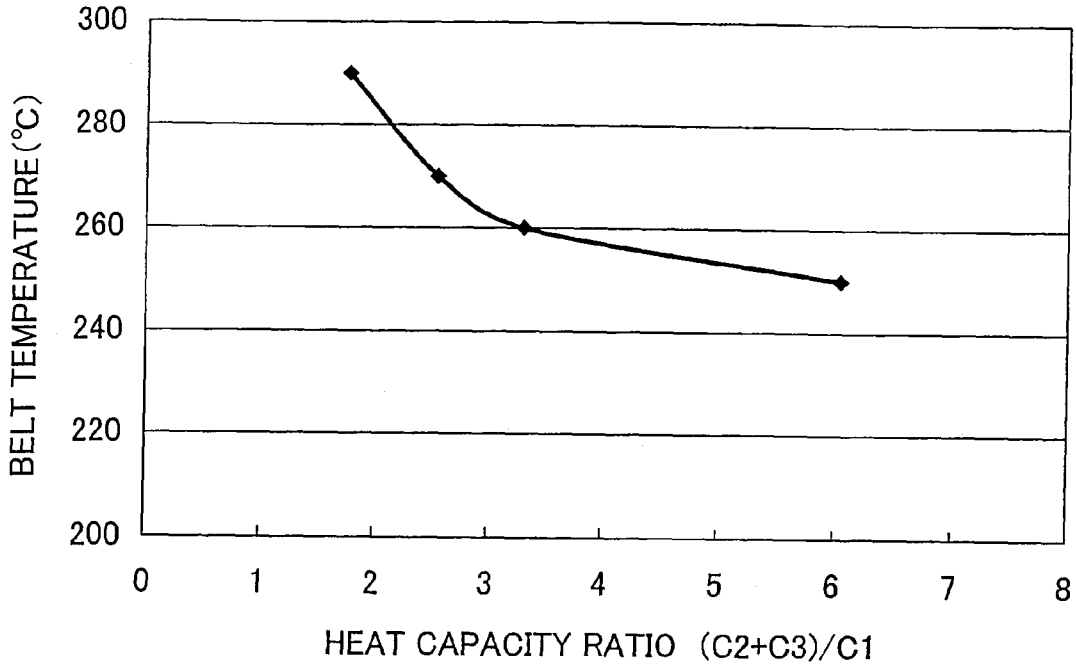
FIG. 6 is a graph showing a relationship between heat capacity ratio in the external heating apparatus and a temperature of an endless belt.

In view of this, the heat capacity ratio (C2+C3)/C1 was changed as illustrated in FIG. 6 by changing a thickness of each of the support rollers 81*a* and 81*b*. After rotations of the fixing roller 60 and the support rollers 81*a* and 81*b* were stopped, a maximum temperature which the endless belt 83 had reached was measured. When the heat capacity ratio decreased, the maximum temperature of the endless belt 83 sharply increased.

Further, heat capacity ratios (C2+C3)/C1 thus obtained were changed in a range from 1 to 4, and the degree of heat damage to the endless belt 83 after rotation of the fixing roller 60 had been stopped was compared. Table 1 shows results of the comparison between the representative four points of the heat capacity ratio. Evaluation in heat damage of the endless belt 83 was made in terms of the presence or absence of a rotational failure in which the endless belt 83 stopped without being moved by the fixing roller 60 at the time of the fixing operation. In Table 1, ○ indicates the absence of the rotational failure. x indicates the presence of the rotational failure.

TABLE 1

| Heat capacity ratio (C2 + C3)/C1 | Heat damage to belt |
|---|---|
| 1 | × |
| 1.9 | × |
| 2 | ○ |
| 3 | ○ |
| 4 | ○ |

As shown in Table 1, it was found that when the heat capacity ratio (C2+C3)/C1 was not more than 1.9, the rotational failure occurred, and when the heat capacity ratio (C2+C3)/C1 was not less than 2, the rotational failure did not occur. Thus, it is preferable that the heat capacity ratio (C2+C3)/C1 is not less than 2.

(Thickness/Thermal Conductivity of Endless Belt)

In Example described above, a thickness/thermal conductivity of the endless belt 83 was 0.0002 $m^2K/W$.

The following will describe an experimental result of Comparative Example 2. In Comparative Example 2, conditions were the same as those in Example described above, except that a thickness of the endless belt 83 was changed from 0.1 mm to 0.6 mm. In Comparative Example 2, a thickness/thermal conductivity of the endless belt 83 was 0.0012 $m^2K/W$.

In Comparative Example 2, temperatures of the members which temperatures were required for maintaining a fixing temperature of 180° C. were as follows: a temperature of each of the support rollers 81*a* and 81*b* was 250° C., and a temperature of the endless belt 83 was 210° C.

That is, a temperature of each of the support rollers 81*a* and 81*b* during the fixing operation when a thickness of the endless belt 83 was 0.6 mm was higher by approximately 30° C. than a temperature of each of the support rollers 81*a* and 81*b* during the fixing operation when a thickness of the endless belt 83 was 0.1 mm. In Comparative Example 2, when the rotation of the fixing roller 60 and heating of the heater lamps 64, 74, 82*a*, 82*b* were stopped, a temperature of each of the support rollers 81*a* and 81*b* reached 270 to 280° C. Also, a temperature of the endless belt 83 in each of the areas where the endless belt 83 was in contact with the support rollers 81*a* and 81*b* reached 270 to 280° C. A surface temperature of the fixing roller 60 at the areas where the fixing roller 60 was in contact with the support rollers 81*a* and 81*b* exceeded 200° C.

The endless belt 83 of polyimide that had undergone the above state caused a rotational failure in which the endless belt 83 stopped without being moved by the fixing roller 60 at the time of the fixing operation. Further, it was observed that the endless belt 83 was floated in the areas where the endless belt 83 was in contact with the fixing roller 60. Due to this float, heat of the endless belt 83 was transmitted inefficiently, which resulted in failure of maintaining the fixing temperature during the fixing operation. In the image obtained right after the fixing operation, unevenness of the image was found by visual observation.

In view of this, (a) the endless belt 83 of polyimide (thermal conductivity of 0.5 W/m·K) in which carbon black was dispersed and (b) the endless belt 83 of polyimide (thermal conductivity of 0.3 W/m·K) were changed in thickness, and thickness/thermal conductivity of the endless belt 83 was changed in a range from 0.002 to 0.0002 $m^2K/W$. Then, the degree of heat damage to the endless belt 83 after rotation of the fixing roller 60 had been stopped was compared. Table 2 shows results of the comparison between the representative four points of thickness/thermal conductivity. Evaluation in heat damage to the endless belt 83 was made as in Table 1 described above (regarding heat capacity ratio).

TABLE 2

| Thickness of belt (mm) | Thickness/ Thermal conductivity ($m^2K/W$) | Heat damage to belt |
|---|---|---|
| PI (carbon black dispersed) belt Thermal conductivity: 0.5(W/m · K) | | |
| 1 | 0.002 | × |
| 0.6 | 0.0012 | × |
| 0.5 | 0.001 | ○ |
| 0.2 | 0.0004 | ○ |
| 0.1 | 0.0002 | ○ |
| PI belt Thermal conductivity: 0.3(W/m · K) | | |
| 0.6 | 0.002 | × |
| 0.36 | 0.0012 | × |
| 0.3 | 0.001 | ○ |
| 0.12 | 0.0004 | ○ |
| 0.06 | 0.0002 | ○ |

As shown in Table 2, when thickness/thermal conductivity of the endless belt 83 was 0.0012 $m^2K/W$ or higher, the rotational failure occurred. On the other hand, when thickness/thermal conductivity of the endless belt 83 was 0.001 $m^2K/W$ or lower, the rotational failure did not occur. Thus, it is preferable that the thickness/thermal conductivity is not more than 0.00 $\mu m^2K/W$.

((width of heating nip area)/(peripheral length of fixing roller 60))

In Example described above, a peripheral length of the fixing roller 60 was $\pi \times 50$ mm=157 mm. On the other hand, a width of the heating nip area N2, which is a peripheral length of the endless belt 83 in an area where the endless belt 83 was in contact with the surface of the fixing roller 60, was 20 mm. As a result, (width of the heating nip area N2)/(peripheral length of the fixing roller 60) was 0.13.

In Comparative Example 3, the endless belt 83 was a belt having a peripheral length of 60 mm, a thickness of 0.1 mm, and a length of 320 mm in major axis direction of the support rollers 81*a* and 81*b*. Each of the support rollers 81*a* and 81*b* was an aluminum hollow pipe having an external diameter of 10 mm, a length of 320 mm, and a thickness of 1 mm. In this case, (width of heating nip area N2)/(peripheral length of the fixing roller 60) was 0.08.

In this case, temperature variations of the members that had temperatures required for maintaining a fixing temperature of 180° C. were as follows: a temperature of each of the support rollers 81*a* and 81*b* was 250° C.; a temperature of the endless belt 83 was 230° C.; and a temperature of the surface of the fixing roller 60 before passing through the fixing nip was 180° C. That is, a temperature of the endless belt 83 during the fixing operation when a width of the heating nip area N2 was 12 mm was higher by approximately 20° C. than a temperature of the endless belt 83 during the fixing operation when a width of the heating nip area N2 was 20 mm.

In Comparative Example 3 in which a width of the heating nip area N2 was 12 mm, when the rotation of the fixing roller 60 and the support rollers 81*a* and 81*b* were stopped due to paper jam, and power supplies to the heater lamps 64, 74, 82*a*, 82*b* were stopped at the same time, a temperature of each of the support rollers 81*a* and 81*b* reached 270 to 280° C. Also, a temperature of the endless belt 83 in each of the areas where the endless belt 83 was in contact with the support rollers 81*a* and 81*b* reached 270 to 280° C. A surface temperature of the fixing roller 60 in the areas where the fixing roller 60 was in contact with the support rollers 81*a* and 81*b* exceeded 200° C.

The endless belt 83 of polyimide that had undergone the above state caused a rotational failure in which the endless belt 83 stopped without being moved by the fixing roller 60 at the time of the fixing operation. Further, it was observed that the endless belt 83 was floated in the areas where the endless belt 83 was in contact with the fixing roller 60. Due to this float, heat of the endless belt 83 was transmitted inefficiently, which resulted in failure of maintaining the fixing temperature during the fixing operation. In the image obtained right after the fixing operation, unevenness of the image was found by visual observation.

In view of this, (width of heating nip section N2)/(peripheral length of fixing roller 60) of fixing apparatuses 40 having the fixing rollers 60 of external diameter of 40 mm, 50 mm, and 60 mm, respectively was changed in a range from 0.08 to 0.16. Then, the degree of heat damage to the endless belt 83 after rotation of the fixing roller 60 had been stopped was compared. Table 3 shows results of the comparison between representative four points of width of the heating nip area N2/peripheral length of the fixing roller 60. Evaluation in heat damage to the endless belt 83 was made as in Table 1 described above (regarding heat capacity ratio).

Note that the external diameter of the pressure roller 70 was the same as that of the fixing roller 60. The fixing speed and the copying speed were adjusted so that the fixing temperature became 180° C. The copying speeds were 50 sheets/minute, 70 sheets/minute, 80 sheets/minute for the fixing roller 60 having an external diameter of 40 mm, the fixing roller 60 having an external diameter of 50 mm, and the fixing roller 60 having an external diameter of 60 mm, respectively.

TABLE 3

| Heating nip width (mm) | Ratio to peripheral length of fixing roller | Heat damage to belt |
|---|---|---|
| Diameter of fixing roller: 50 mm (Fixing nip width: 9 mm, fixing speed: 355 mm/s) | | |
| 12 | 0.08 | × |
| 16 | 0.1 | ○ |
| 20 | 0.13 | ○ |
| 25 | 0.16 | ○ |
| Diameter of fixing roller: 40 mm (Fixing nip width: 6 mm, fixing speed: 250 mm/s) | | |
| 10 | 0.08 | × |
| 12.5 | 0.1 | ○ |
| 16 | 0.13 | ○ |
| 20 | 0.16 | ○ |

TABLE 3-continued

| Heating nip width (mm) | Ratio to peripheral length of fixing roller | Heat damage to belt |
|---|---|---|
| Diameter of fixing roller: 60 mm (Fixing nip width: 11 mm, fixing speed: 450 mm/s) | | |
| 15 | 0.08 | × |
| 19 | 0.1 | ○ |
| 25 | 0.14 | ○ |
| 30 | 0.16 | ○ |

As shown in Table 3, it was found that when (width of the heating nip area N2)/(peripheral length of the fixing roller 60) was 0.08, the rotational failure began to occur. On the other hand, it was found that when (width of the heating nip area N2)/(peripheral length of the fixing roller 60) was not less than 0.1, the rotational failure did not occur. Thus, it is preferable that (width of the heating nip area N2)/(peripheral length of the fixing roller 60) is not less than 0.1.

(Glass Transition Temperature or Melting Temperature of Endless Belt)

In Example described above, the endless belt 83 had a glass transition temperature Tg of 310° C. and a continuous operation temperature (highest temperature at which the endless belt 83 are able to continuously operate for a predetermined time period) of 240° C.

On the other hand, in Comparative Example 4 using the endless belt 83 made of PET, a glass transition temperature Tg of 110° C., and a continuous operation temperature of 105° C., when the rotation of the fixing roller 60 and the support rollers 81*a* and 81*b* were stopped due to paper jam, and power supplies to the heater lamps 64, 74, 82*a*, 82*b* were stopped at the same time, it was found that the endless belt 83 was deformed and partially stuck to the support rollers 81*a* and 81*b*.

In view of this, endless belts 83 having mutually different glass transition temperatures Tg in the range from 200 to 400° C. were prepared, and the degree of heat damage to the endless belt 83 after the rotation of the fixing roller 60 was stopped was compared between the prepared endless belts 83.

As a result, it was found that when the glass transition temperature Tg was not less than 250° C., the endless belt 83 was not subjected to a serious heat damage. Thus, it is preferable that the glass transition temperature Tg of the endless belt 83 is not less than 250° C. It is more preferable that the glass transition temperature Tg is not less than 300° C. since the endless belt 83 is more resistant to heat damage, and thus less rotational failure occurs.

Further, the endless belt 83 may be a metallic belt made of metal such as stainless steel or nickel. If the endless belt 83 is the metallic belt, it is preferable that a melting temperature of the metallic belt is not less than 250° C. Note that since metal melting temperatures of the metals such as stainless steel and nickel are normally not less than 300° C., the metallic belt resists heat damage.

(Gas Filled in Heater Lamps)

In Example described above, the heater lamps 82*a* and 82*b* provided in the support rollers 81*a* and 81*b* were halogen lamps each of which was filled with a gas having a thermal conductivity of $110\times10^{-4}$ W/mK.

In view of this, as the heater lamps 82*a* and 82*b*, four kinds of halogen lamps each of which was filled with a gas having different thermal conductivity were used to conduct an experiment for evaluation of heat damage as in the above experiment. A result of the experiment is shown in Table 4. In Table 4, "Δ" represents the presence of rotational failure which did not always occur.

TABLE 4

| Thermal conductivity of filled gas (W/mk) | Components of filled gas | Valve temperature (° C.) | Belt temperature (° C.) | Heat damage to belt |
|---|---|---|---|---|
| $177 \times 10^{-4}$ | 99% argon, 1% bromide | 400 | 280 | × |
| $130 \times 10^{-4}$ | 62% argon, 37% xenon, 1% bromide | 340 | 255 | Δ |
| $110 \times 10^{-4}$ | 45% argon, 54% xenon, 1% bromide | 330 | 250 | ○ |
| $56 \times 10^{-4}$ | 99% xenon, 1% bromide | 290 | 240 | ○ |

As shown in Table 4, when a thermal conductivity of the filled gas was not more than $110\times10^{-4}$ W/m·K, it is possible to prevent heat of filament of the halogen lamp from being unnecessarily transmitted to the filled gas and the glass tube (valve). As a result, it is possible to prevent rise in temperatures of the glass tubes of the heater lamps 82*a* and 82*b*.

With this, after the rotation of the fixing roller 60 and the support rollers 81*a* and 81*b* are stopped due to paper jam or other reason, and power supplies to the heater lamps 64, 74, 82*a*, 82*b* are stopped at the same time, the amount of heat transmitted from the heater lamps 82*a* and 82*b* to the support rollers 81*a* and 81*b* becomes small, which suppresses rise in temperature of the support rollers 81*a* and 81*b*. As a result, it is possible to suppress local rise in temperature of the endless belt 83 and the fixing roller 60. Furthermore, heat damage (degradation due to temperature) to the surfaces of the endless belt 83 and the fixing roller 60 are suppressed. Besides, unevenness of the image caused by overheat of a part of the surface of the fixing roller 60 is reduced.

(External Heating Device for Pressure Roller)

Figure 7:
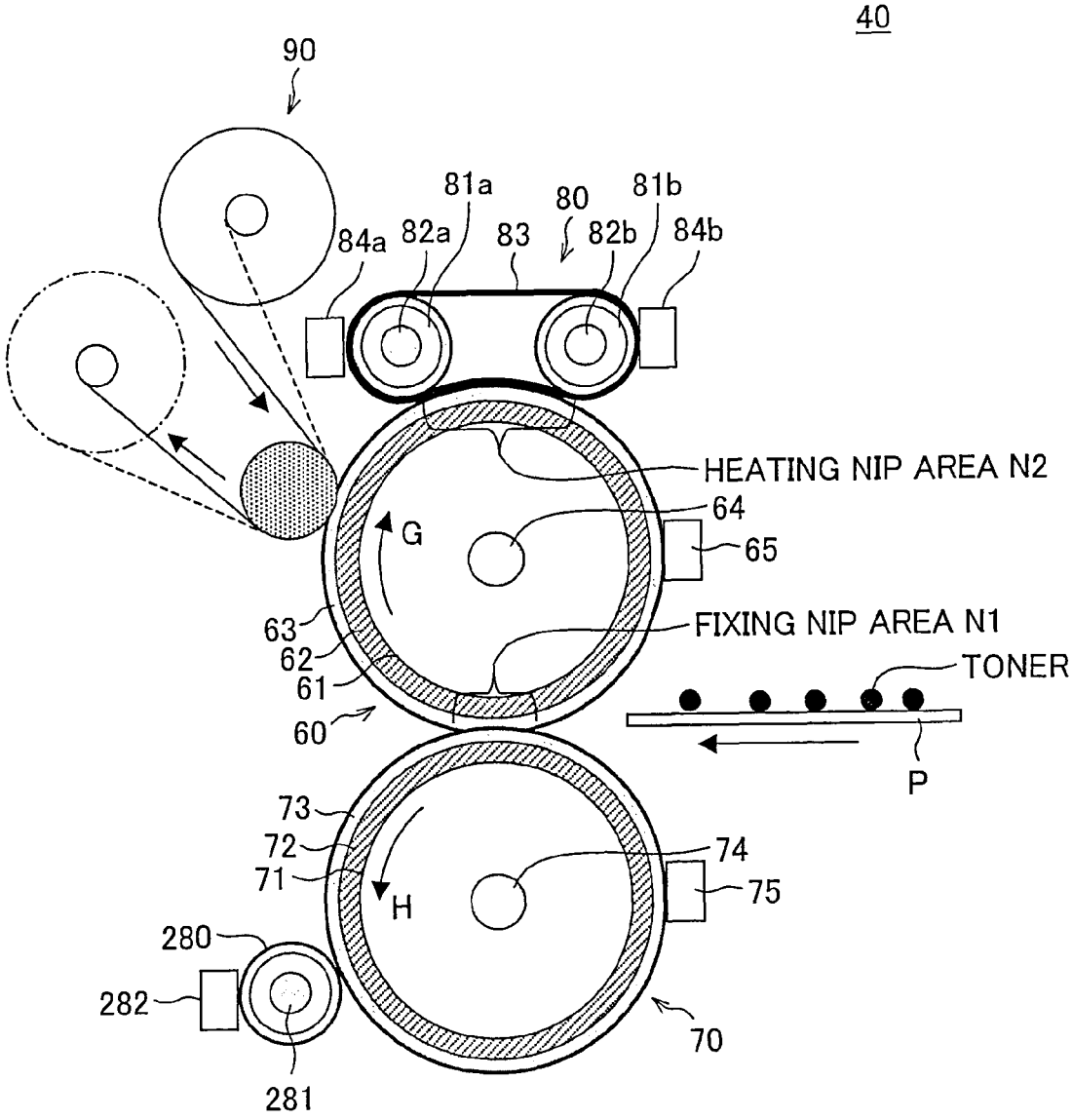
FIG. 7 is a diagram schematically illustrating a structure of another modified fixing apparatus according to an embodiment of the present invention.

An external heating device for the pressure roller 70 may be added to the arrangement illustrated in FIG. 1. FIG. 7 is a diagram illustrating a structure of the fixing apparatus 40 of the present Example. As illustrated in FIG. 7, a heating roller 280 was provided as an external heating device so as to abut on the outer surface of the pressure roller 70.

The heating roller 280 was a SUS roller having an external diameter of 20 mm and a thickness of 1 mm, and being coated with 20 um-fluorocarbon resin on an outer layer of the roller.

Further, a heater lamp 281 is provided inside the heating roller 280, and a thermistor 282 is provided to detect a temperature of the outer surface of the heating roller 280. In the present Example, the heater lamp 281 was a 500 W-halogen lamp.

During the fixing operation, heat is supplied to the surface of the pressure roller 70 from the heating roller 280 rather than from the heater lamp 74 provided inside the pressure roller 70 in order to prevent a temperature of the pressure roller 70 from decreasing. At the warm-up, power is supplied to both the heater lamp 74 and the heater lamp 281 to light up the heater lamp 74 and the heater lamp 281 so that a temperature of the pressure roller 70 is raised quickly.

Thus, by providing the heating roller 280 for the pressure roller 70 that faces the fixing roller 60 for heating the unfixed toner, it is possible to reduce the warm-up time and to quickly and efficiently respond to a decrease in temperature of the pressure roller 70 during a paper passing. Note that since a temperature of the pressure roller 70 may be lower than that of the fixing roller 60, the heating roller 280 having a heat source therein can be used as external heating means. This makes it possible to realize a simpler arrangement than the external heating device 180 using the endless belt 83 (see FIG. 5), thus realizing size reduction of the fixing apparatus.

As described above, a fixing apparatus according to the present invention is a fixing apparatus comprising: a fixing member which transports a recording material while sandwiching the recording material so that an unfixed toner image formed on the recording material is fixed on the recording material under heat and pressure; a plurality of support rollers; an endless belt which is set over the support rollers and comes into contact with a surface of the fixing member; and heating means which are provided respectively inside the support rollers, wherein a relationship indicated by the following equation (1) is satisfied: $(C2+C3)/C1 \geqq 2$ . . . (1) where C1 is a heat capacity of the heating means, C2 is a heat capacity of each of the support rollers, and C3 is a heat capacity of the endless belt in each of areas where the endless belt is in contact with the support rollers.

Here, the reason why the overshoot occurs is explained.

The external belt heat fixing process offers a high ability to supply heat to the fixing member. In addition, heat is transmitted from the heating means to the surface of the fixing member, passing though a plurality of members (i.e. support rollers and endless belt) provided between the heating means and the surface of the fixing member. As a result, wide temperature variations occur between the heating means and the surface of the fixing member. That is, temperature variations between the heating means, the support rollers, the endless belt, and the fixing member are as follows: heating means>support rollers>endless belt>fixing member.

Then, when the rotation of the fixing member is stopped and heat transmission to the fixing member is interrupted, temperatures of the support rollers and the endless belt rise due to the temperature variations.

Especially, in the conventional external belt heat fixing process, since heat capacities of the support rollers and the endless belt are small, overshoot due to the temperature variations noticeably occurs. Thus, such an overshoot becomes noticeable especially in a case when operation is suddenly stopped, like at the time of paper jam.

Next, a relationship between a temperature of the heating means and overshoot is explained.

When heat supply by the heating means is stopped at the stop of rotation of the fixing member, the heating means keeps a high temperature for a while. This increases a temperature of the support rollers and contributes to the occurrence of overshoot. A general halogen lamp as heating means has a heat wire such as tungsten inside a glass tube. This allows the glass tube of the halogen lamp to have a temperature higher by at least 100° C. than a temperature of the support rollers when the halogen lamp was turned off. The heat of the glass tube is transmitted to the support rollers by radiation and heat conduction through the air. This heats the support rollers. The smaller a heat capacity of the support rollers and the larger a heat capacity of the glass tube of the halogen lamp, the higher a rate of rise in temperature of the support rollers.

Therefore, a temperature of the support rollers which temperature is high due to the temperature variations during the fixing operation is further increased by heat of the heating means after the completion of the fixing (stop of rotation of fixing member) and at the time of paper jam. A temperature of the endless belt that is in contact with the support rollers rises to substantially the same temperature as the temperature of the support rollers since a heat capacity of the endless belt is small.

On the contrary, according to the above arrangement of the present invention, a relationship between the heat capacity C1 of the heating means, the heat capacity C2 of the support rollers, and the heat capacity C3 of the endless belt in each of areas where the endless belt is in contact with the support rollers is as indicated by the above-mentioned equation (1). That is, heat capacities of the support rollers and the endless belt are larger than a heat capacity of the heating means, as compared with the conventional arrangement.

In a situation where the equation (1) is satisfied, rise in temperature of the support rollers is suppressed even when heat of the heating means is transferred to the support rollers after the completion of the fixing (when the rotation of the fixing member is stopped) and at the time of paper jam. As a result, it is possible to suppress local rise in temperature of the endless belt and the fixing member. Thus, it is possible to suppress degradation due to temperatures of the surfaces of the endless belt and the fixing member, and to reduce unevenness of the image.

Further, a fixing apparatus according to the present invention is a fixing apparatus comprising: a fixing member which transports a recording material while sandwiching the recording material so that an unfixed toner image formed on the recording material is fixed on the recording material under heat and pressure; a plurality of support rollers; an endless belt which is set over the support rollers and comes into contact with a surface of the fixing member; and heating means which are provided respectively inside the support rollers, wherein a relationship indicated by the following equation (2) is satisfied: $t/\lambda \leqq 0.001\ m^2K/W$ . . . (2) where t is a thickness of the endless belt, and $\lambda$ is a thermal conductivity of the endless belt.

As described previously, temperature variations during the fixing operation are as follows: heating means>support rollers>endless belt>the surface of the fixing member. It is clear from the experiment that a difference in temperature between the support rollers and the endless belt depends on heat conduction of the endless belt. Thus, the lower a value of $t/\lambda$ where t is a thickness of the endless belt and $\lambda$ is a thermal conductivity, the more excellent thermal conductivity. This makes it possible to reduce the difference in temperature.

After rotation of the fixing member and heating of the heating means are stopped at the completion of the fixing and at the time of paper jam, a temperature of each of the areas where the endless belt is in contact with the support rollers rises to substantially the same temperature as a temperature of the support rollers. Then, since temperatures of the support rollers are increased by heat of the heating means, a temperature of the endless belt is further increased. Therefore, decrease of the difference in temperature between the support rollers and the endless belt in the temperature variations leads to suppression of rise in temperature of the endless belt.

In a situation where the equation (2) is satisfied, it is possible to suppress the difference in temperature between the belt suspending rollers and the endless belt to not more than approximately 20° C. Further, in a situation where the equation (2) is satisfied, rise in temperature of the endless belt is suppressed even when heat of the heating means is transferred to the support rollers after the completion of the fixing (when the rotation of the fixing member is stopped) and at the time of paper jam. As a result, it is possible to suppress local rise in temperature of the fixing member. Thus, it is possible to suppress degradation due to temperatures of the surfaces of the endless belt and the fixing member, and to reduce unevenness of the image. Still further, in a situation where the equation (2) is satisfied, it was confirmed that degradation due to temperatures of the surfaces of the endless belt and the fixing member was not found and it was possible to reduce unevenness of the image.

It is preferable to reduce the thickness of the endless belt since the reduction in thickness of endless belt decreases the difference in temperature between the support rollers and the endless belt. However, there is the possibility that the reduction in thickness of endless belt leads to decrease of the sum of (a) heat capacity of each of the support rollers and (b) heat capacity of the endless belt. For this reason, it is preferable to reduce the thickness of the endless belt and increase the thickness of the support rollers accordingly in order not to decrease the sum of (a) heat capacity of each of the support rollers and (b) heat capacity of the endless belt.

Further, a fixing apparatus according to the present invention is a fixing apparatus comprising: a fixing member which transports a recording material while sandwiching the recording material so that an unfixed toner image formed on the recording material is fixed on the recording material under heat and pressure; a plurality of support rollers; an endless belt which is set over the support rollers and comes into contact with a surface of the fixing member; and heating means which are provided respectively inside the support rollers, wherein a ratio of a length of the endless belt in a moving direction of the endless belt in an area of the endless belt that is in contact with the surface of the fixing member is not less than 0.1 relative to a peripheral length of the fixing member.

As described previously, temperature variations during the fixing operation are as follows: heating means>support rollers>endless belt>the surface of the fixing member. It is clear from the experiment that a difference in temperature between the endless belt and the fixing member depends on a length of the endless belt in a moving direction of the endless belt (heating nip width).

It is clear from the experiment that it is possible to suppress the difference in temperature between the surface of the endless belt and the surface of the fixing member to not more than 30 to 40° C. especially when a ratio of the heating nip width is not less than 0.1 relative to a peripheral length of the fixing member. Decrease of the difference in temperature between the surface of the endless belt and the surface of the fixing member makes it possible to suppress temperatures of the endless belt and the support rollers to lower temperatures during the fixing operation. As a result, it was confirmed that the above arrangement makes it possible to suppress degradation due to temperatures of the surfaces of the endless belt and the fixing member and to reduce unevenness of the image, after the rotation of the fixing member and the heating of the heating means are stopped due to the completion of the fixing, paper jam, or other reason.

Further, in addition to the above arrangement, a fixing apparatus according to the present invention is preferably such that a lower temperature of (a) a glass transition temperature and (b) a melting temperature of the endless belt is not less than 250° C.

Due to the temperature variations during the fixing, temperatures of the support rollers and the endless belt become higher than that of the fixing member. However, according to the above arrangement, since the endless belt has an excellent heat resistance, heat damage to the endless belt is reduced even when the endless belt is in the form of film.

Still further, a fixing apparatus according to the present invention is preferably such that the heating means are halogen lamps each of which is filled with a gas having a thermal conductivity of not more than $110\times10^{-4}$ W/m·K.

As compared with a halogen lamp which is filled with a gas having a thermal conductivity of $177\times10^{-4}$ W/m·K, it is possible to more effectively suppress unnecessary heat transmission of filament to the filled gas and the valve (glass tube). As a result, it was found from the experiment that it is possible to decrease a valve temperature of the halogen lamp by at least 100° C.

With this, the amount of heat that transfers from the heating means to the support rollers decreases and rise in temperature of the support rollers is suppressed after the rotation of the fixing member and heating of the heating means are stopped. As a result, it is possible to suppress local rise in temperature of the endless belt and the fixing member. Thus, it is possible to suppress degradation due to temperatures of the surfaces of the endless belt and the fixing member, and to reduce unevenness of the image.

Yet further, a fixing apparatus according to the present invention is such that the fixing member comprises a fixing roller and a pressure roller both of which sandwich the recording material therebetween, the fixing roller comes into contact with the unfixed toner image formed on the recording material, and the endless belt comes into contact with a surface of the fixing roller.

According to the above arrangement, it is possible to efficiently heat unfixed toner and to reduce (i) power consumption at the time of fixing and (ii) the warm-up time.

Further, a fixing apparatus according to the present invention is a fixing apparatus comprising: a fixing roller and a pressure roller which transport a recording material while sandwiching the recording material therebetween; a plurality of support rollers; an endless belt which is set over the support rollers and comes into contact with a surface of the fixing roller; and heating means which are provided respectively inside the support rollers, the fixing roller fixing an unfixed toner image formed on the recording material thereon under heat and pressure, the fixing apparatus further comprising: a heat roller which is in contact with a surface of the pressure roller and heats the pressure roller from outside the pressure roller.

According to the above arrangement, by providing the heating roller for the pressure roller that faces the fixing roller, it is possible to reduce the warm-up time and to quickly and efficiently respond to decrease in temperature of the pressure roller during the fixing process. Note that since a temperature of the pressure roller may be lower than that of the fixing roller, the heating roller having a heat source therein can be used. This makes it possible to realize the fixing apparatus that is smaller in size than the fixing apparatus including the external heating device using the endless belt.

Further, quickly heating the pressure roller increases the amount of available heat supplied from the pressure roller to the recording material. As a result, the amount of heat to be supplied from the fixing roller is suppressed. This effect reduces temperature variations between the heating means, the support rollers, and the endless belt all of which are members for supplying heat to the surface of the fixing roller, thus suppressing rise in temperature of the endless belt that is in contact with the fixing roller. This makes it possible to suppress degradation due to temperatures of the surfaces of the endless belt and the fixing member, and to reduce unevenness of the image.

Still further, an image forming apparatus according to the present invention includes: toner image forming means for forming a toner image on the recording material; and the above fixing apparatus. This makes it possible to prevent degradation due to temperatures of the surfaces of the endless belt and the fixing member, and to reduce unevenness of the image.

The embodiment and concrete example of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus comprising:

a fixing member which transports a recording material while sandwiching the recording material so that an unfixed toner image formed on the recording material is fixed on the recording material under heat and pressure;

a plurality of support rollers;

an endless belt which is set over the support rollers and comes into contact with a surface of the fixing member; and heating means which are provided respectively inside the support rollers, wherein a relationship indicated by the following equation (1) is satisfied:

$$(C2+C3)/C1 \geqq 2 \quad (1)$$

where C1 is a heat capacity of the heating means, C2 is a heat capacity of each of the support rollers, and C3 is a heat capacity of the endless belt in each of areas where the endless belt is in contact with the support rollers.

2. The fixing apparatus according to claim 1, wherein a lower temperature of (a) a glass transition temperature and (b) a melting temperature of the endless belt is not less than 250° C.

3. The fixing apparatus according to claim 1, wherein the heating means are halogen lamps each of which is filled with a gas having a thermal conductivity of not more than $110\times10^{-4}$W/m·K.

4. The fixing apparatus according to claim 1, wherein the fixing member comprises a fixing roller and a pressure roller both of which sandwich the recording material therebetween, the fixing roller comes into contact with the unfixed toner image formed on the recording material, and the endless belt comes into contact with a surface of the fixing roller.

5. An image forming apparatus comprising: a fixing apparatus which includes a fixing member which transports a recording material while sandwiching the recording material so that an unfixed toner image formed on the recording material is fixed on the recording material under heat and pressure, a plurality of support rollers, an endless belt which is set over the support rollers and comes into contact with a surface of the fixing member, and heating means which are provided respectively inside the support rollers; and toner image forming means for forming a toner image on the recording material, wherein a relationship indicated by the following equation (1) is satisfied:

$$(C2+C3)/C1 \geqq 2 \quad (1)$$

where C1 is a heat capacity of the heating means, C2 is a heat capacity of each of the support rollers, and C3 is a heat capacity of the endless belt in each of areas where the endless belt is in contact with the support rollers.

* * * * *